US010899140B2

(12) United States Patent
Schneider et al.

(10) Patent No.: US 10,899,140 B2
(45) Date of Patent: Jan. 26, 2021

(54) AUTOMATED DEVICE FOR ADJUSTING PRINT HEADS

(71) Applicant: Oce Holding B.V., Venlo (NL)

(72) Inventors: Claus Schneider, Eching (DE); Christoph Rummelsberger, Ismaning (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/723,092

(22) Filed: Dec. 20, 2019

(65) Prior Publication Data

US 2020/0198364 A1 Jun. 25, 2020

(30) Foreign Application Priority Data

Dec. 21, 2018 (DE) ..... 10 2018 133 342

(51) Int. Cl.
*B41J 25/00* (2006.01)
*B41J 2/21* (2006.01)
*B41J 2/045* (2006.01)

(52) U.S. Cl.
CPC ..... *B41J 2/2135* (2013.01); *B41J 2/04505* (2013.01); *B41J 25/003* (2013.01)

(58) Field of Classification Search
CPC ..... B41J 2/2135; B41J 2/04505; B41J 2/155; B41J 2202/19; B41J 2202/20; B41J 25/003; B41J 2/2146; B41J 25/001
See application file for complete search history.

(56) References Cited

U.S. PATENT DOCUMENTS

2017/0250414 A1* 8/2017 Boillat ..... H01M 8/04126
2017/0341439 A1* 11/2017 Weismantel ..... B41J 25/001

FOREIGN PATENT DOCUMENTS

DE 102010060412 B4 10/2017
DE 102017215314 A1 4/2018
EP 1764996 A1 3/2007
EP 3216565 A1 9/2017

OTHER PUBLICATIONS

English translation of DE-102010060412, published on May 2012 (Year: 2012).*
English translation of DE-102017215314, published on May 2018 (Year: 2018).*
German Office Action dated Jun. 17, 2019, for Application No. 10 2018 133 342.0.

* cited by examiner

*Primary Examiner* — Huan H Tran
(74) *Attorney, Agent, or Firm* — Schiff Hardin LLP

(57) ABSTRACT

A device for automatic adjustment of print heads in a printing machine is presented. The device can include at least one motor and a controller. The motor can drive at least one drive element for at least one retaining element, and drive at least one drive element for at least one adjustment element. The controller can control the at least one motor to: drive the at least one drive element to loosen the at least one retaining element, drive the at least one drive element to position the at least one adjustment element at a predetermined nominal value to position the adjustment element, and drive the at least one drive element to tighten the at least retaining element.

11 Claims, 5 Drawing Sheets

(Related Art)

AUTOMATED DEVICE FOR ADJUSTING PRINT HEADS

CROSS REFERENCE TO RELATED APPLICATIONS

This patent application claims priority to German Patent Application No. 102018133342.0, filed Dec. 21, 2018, which is incorporated herein by reference in its entirety.

BACKGROUND

Field

An electronically controlled hand tool for automatic mechanical adjustment of print heads.

Related Art

Digital printing machines are often used for single-color or multicolor printing to various recording media, such as paper, cardboard, or plastic films. These often operate in an inkjet process and generate the individual dots with a plurality of nozzles. In the single office/home office (SOHO) field, a single print head having such a plurality of nozzles is often used. This print head is then displaced by a motor over the width of the recording medium. If the print head has printed to a defined region over the complete width of the recording medium, the recording medium is displaced by a small distance in the longitudinal direction and the print head begins with the printing to the next region.

In high-speed printing, as is the case here, a large quantity of recording medium is printed to at high speed. Therefore, multiple print heads are arranged side by side and one after another in a print bar so that the entire width of the recording medium may be reached. The through-transport of the recording medium in the longitudinal direction, below the print bar, then takes place continuously with constant high velocity.

The precise mechanical alignment of the individual print heads in the print bar is a critical factor for a high-grade printing result.

A method for mechanically adjusting print heads is described in DE 10 2010 060 412 B4. Two retaining screws hereby fix the print head after the print head has been displaced, counter to a mechanical pre-load, in a defined position via two lever arms with defined working points in two directions (x, φ) of a plane, which lever arms are articulated by adjusting screws.

In the practical implementation of the method described in the patent, it has been shown that the precise adjustment of the individual print heads in the print bar is very elaborate. For example, if a 56 cm-wide recording medium is present, five print heads are arranged so that they extend across the width of the recording medium. If printing should take place with not only one color, but rather with four or seven, for example, the number of print heads in the printing machine increases by just this factor of the number of print colors. To increase the printing speed, in high-speed printing two or more print bars per color are sometimes arranged one after another in the longitudinal direction.

A high number of print heads thus must be aligned. This alignment takes place in an iterative method, in the first instance after the initial installation and upon startup of the digital printing machine, and thereafter additionally upon every changing of a print head or print bar. First, a test image is printed with every print bar with every print head of the print bars. Then, the relative position of the individual dots on the recording medium that has been printed to is measured with a scanner or a camera. The position of the nozzles, and thus of the print heads in the print bars, is then determined from the measurement result and the data regarding activation of the nozzles.

After the determination of the position of the individual print heads, the adjustment described in the patent is then performed, for every print head, in the two directions (x, φ) of the plane in which the nozzles of the print heads reside. This adjustment is performed by the installation personnel with hand tools (screwdrivers or spanners) using a table with values that is conveyed to said installation personnel. It has been shown that the precision that can be achieved with such a manual adjustment is limited to approximately half of a rotation of the adjusting screw. Numerous errors may occur given this manual adjustment, such as misreading the table, adjustment of the wrong print head, adjustment of the correct print head in the wrong direction, errors in tightening the retaining screws, incorrect number of rotations of the adjusting screw etc.

After the first adjustment, the test image is reprinted with every print bar with every print head of the print bars. This test image is measured again, and the position of the individual print heads is determined therefrom. It has been shown that the necessary result is rarely achieved with the first readjustment of the print head position. The adjustment of the individual print heads must consequently be repeated using the result of the last test image.

Due to the plurality of print heads and the tendency toward error in the adjustment by hand, a plurality of iterations is required so that a print image of the required quality is finally achieved. The process of the detection of the print image resulting from a specific adjustment of the print heads may be accelerated with a detection device, such as a scanner or a camera, mounted at the exit of the printing machine, because an evaluation by means of a separate scanner may be omitted. Nevertheless, a high cost for the manual adjustment of the individual print heads continues to exist.

This high cost is additionally required not only at the first installation but rather also given every replacement of one or more print heads, or given a repair to the print bar. The availability of the printing machine is thus significantly negatively affected by this high service cost.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1 schematically shows a print bar with five print heads.

Figure 1:
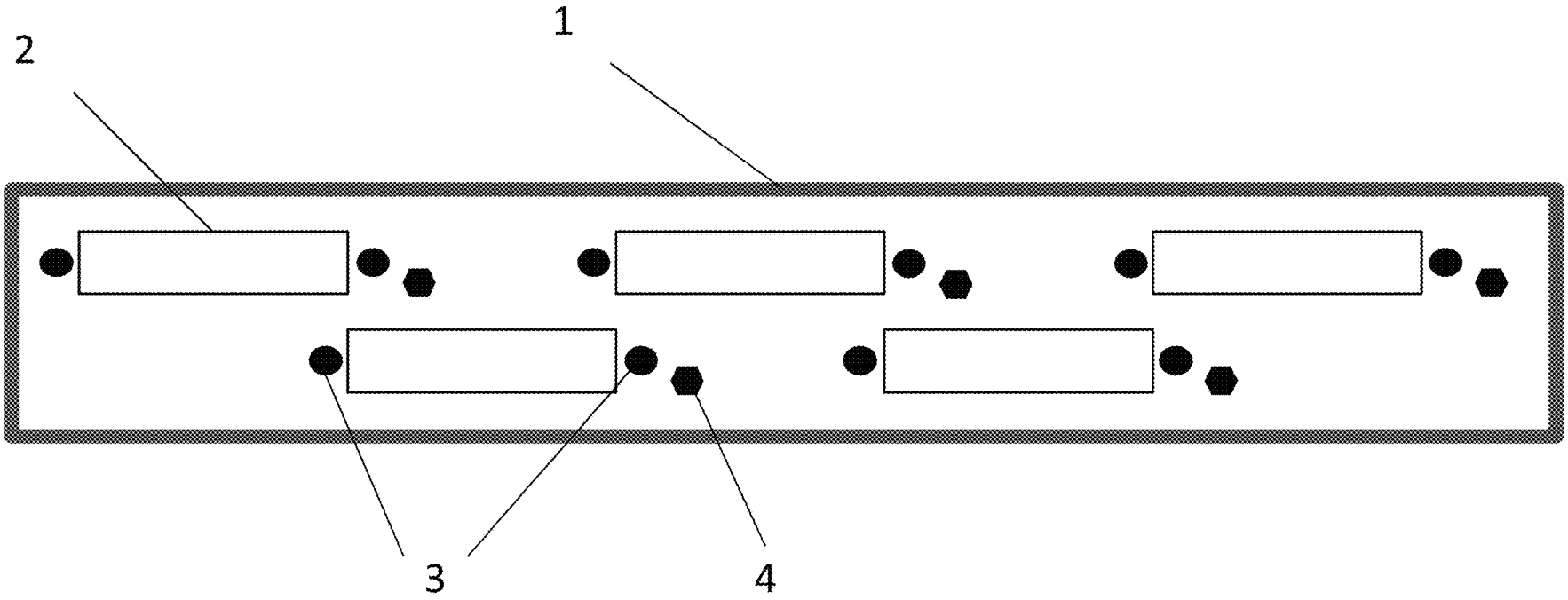

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

It is the object of the disclosure to implement the configuration process of print heads with more precision, certainty, and speed.

In an aspect of the disclosure, a device for automatic adjustment of print heads in a printing machine is provided. In an exemplary embodiment, the device includes at least one motor configured to drive at least one drive element for at least one retaining element, and to drive at least one drive element for at least one adjustment element. The device can also include a controller configured to control the at least one motor to: drive the at least one drive element to loosen the at least one retaining element; drive the at least one drive element to position the at least one adjustment element at a predetermined nominal value for the position of the adjustment element; and drive the at least one drive element to tighten the at least retaining element. In an exemplary aspect, a method for automatic adjustment of print heads in a printing machine is provided. In an exemplary embodiment, the method is implemented by an electronically controlled hand tool having at least one motor for driving at least one drive element for at least one retaining element, and for driving at least one drive element for at least one adjustment element, and having a controller for controlling the at least one motor to: loosen the at least one retaining element, position the at least one adjustment element at a predetermined nominal value for a position of said adjustment element, and tighten the at least one retaining element.

FIG. 1 shows a conventional print bar 1, which covers the entire width—for example 56 cm—of the recording medium with five print heads. Such print bars are permanently installed in digital printing machines if higher throughput is necessary than given printers in the SOHO field. The recording medium is transported through below this print bar, thus from bottom to top in FIG. 1, for example. One such print bar is typically used per print color. Therefore, for CMYK printing, there are four print bars, and for CMYK-OGV printing, there are seven print bars. Two or more print bars may be arranged in succession per print color to further increase throughput. Each of the print heads 2 is fixed in its position with two retaining elements 3. The angle between the longer dimension of the print head and the longer dimension of the print bar is finely adjusted via an adjusting screw 4, referred to as an adjustment element.

In the ideal case, this angle should be zero. However, it has been established that the smallest deviations from the zero position lead to significant inhomogeneities. Areas that should be printed in monochrome have alternating lighter and darker streaks. These streaks arise because a print head contains many nozzle rows in series, wherein the nozzles in the individual rows are arranged offset from one another. Given deviations from the correct angle position, two nozzles that are actually arranged offset in different rows may be positioned one after another in the transport direction of the recording medium. Regions with too much ink and regions with too little ink, thus dark and light streaks, which travel in the transport direction of the recording medium, thereby arise in the vicinity of these nozzles.

In an exemplary embodiment, in addition to an adjustment element for adjusting the angle position of the print head, an adjustment element 4 is provided for the adjustment of a print head 2 in the direction of the longer dimension of print head and print bar, which is not shown in FIG. 1.

Figure 2:
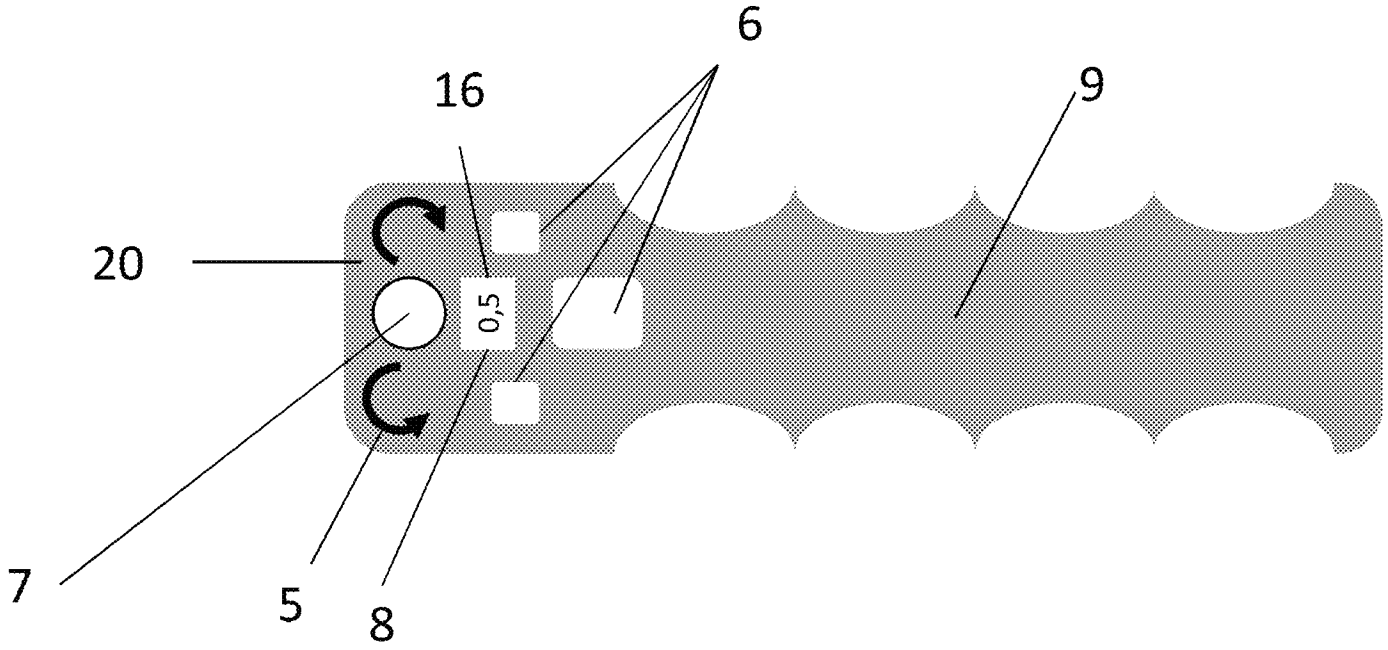
FIG. 2 is a plan view of a device according to an exemplary embodiment.
Figure 3:
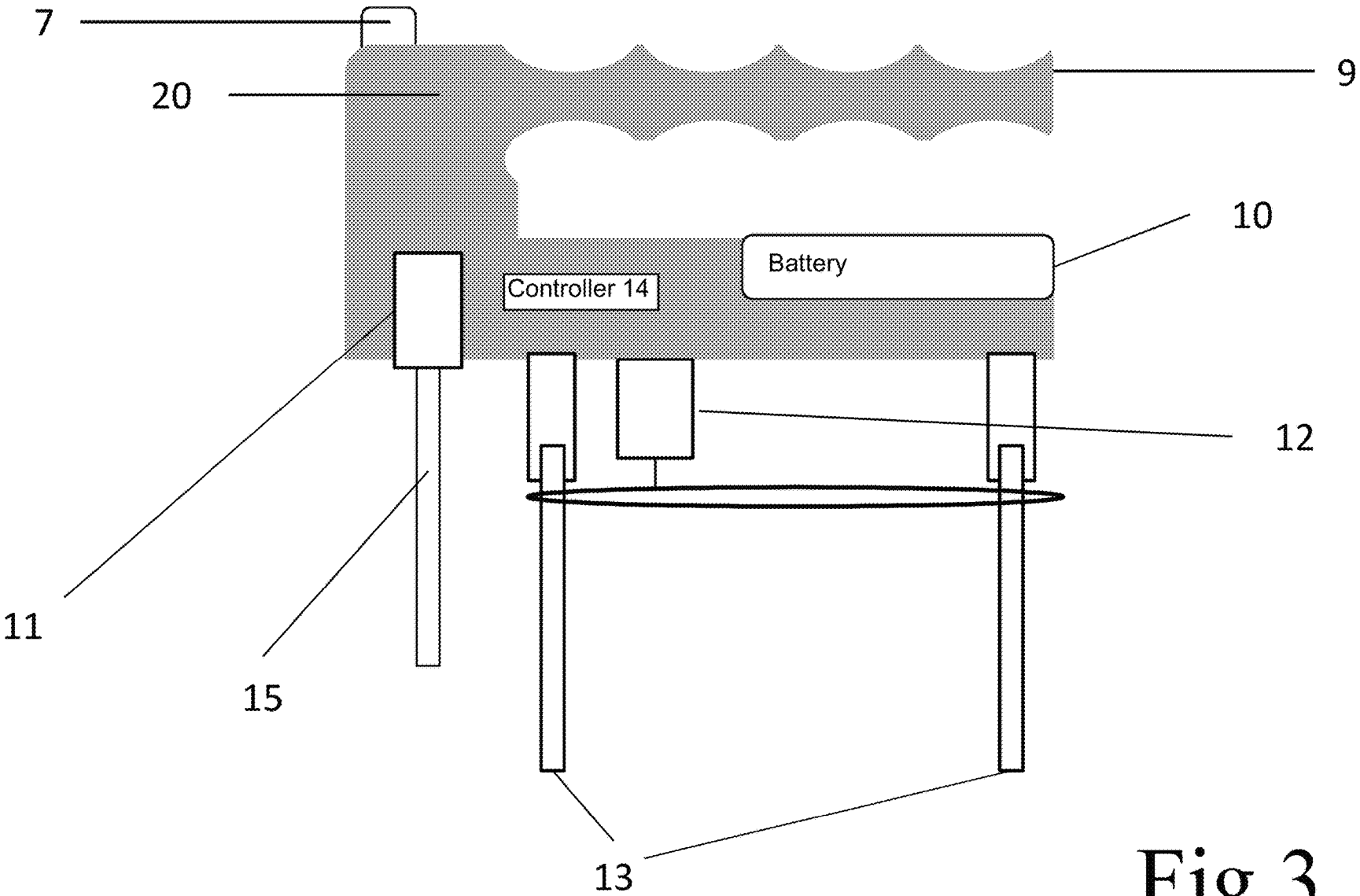
FIG. 3 is a side view of the device of FIG. 2.

FIGS. 2 and 3 show a device 20 for automatically aligning a print head according to an exemplary embodiment. In an exemplary embodiment, there is a grip 9 on the body of the device. Located on the side facing toward the operator are: direction indicators 5; operating elements such as buttons 6 and an additional operating element 7 which, in FIGS. 2 and 3, is depicted as a rotary knob; at least one indicator 8 on which is reproduced here, by way of example, a rotation angle for the adjustment element 4 of 0.5 rotations as a nominal value 16. The operating element 7 is executed as a rotary knob in FIG. 2. The operating elements 6 and 7, the display element 8, and the direction indicators 5 may be combined in a touchscreen. The elements 5, 6, 7, and 8 operate together with a controller 14 (FIG. 3), for example a microcomputer. In an exemplary embodiment, the controller includes processor circuitry that is configured to perform one or more operations/functions of the controller. The power supply of the device 20 takes place via a battery 10 that can possibly be recharged. The shaft of a motor 11 is connected with a socket wrench 15 with insert. This socket wrench 15 with insert serves as a drive element for the adjustment element 4. The shaft of a motor 12 is connected with two socket wrenches 13 with insert via a gearing that is schematically depicted in FIG. 2. This socket wrench 13 with insert serves as a drive element for the retaining elements 3.

The inserts for hexagonal nuts, hexagonal screw heads, or Allen or Torx screw heads are typically provided with six or twelve engagement elements (6-sided insert or 12-sided insert). 360°/6, thus 60°, of precision for the rotation angle may thus be provided with such inserts, even 30° given 12-sided inserts. This is an improvement relative to the precision of one half rotation, thus 180°, that has previously been provided to the adjusting personnel.

In an exemplary embodiment, the motor 12 for loosening and tightening the retaining element 3 with the gearing is tuned so that the maximum achievable torque corresponds to the nominal value for the torque with which the print head should be tightened.

If, by design, a nominal value is present not only for the torque with which the print head should be tightened, a torque regulation is to be provided for the motor 12.

In an exemplary embodiment, the device described in the preceding may be supplemented by elements that also enable an adjustment of a print head in the direction of its longer dimension. For this purpose, the elements of motor for the adjustment element 11 and drive element for the adjustment element 15 are merely to be brought into a corresponding position of the device 20 again. The method is then likewise to be supplemented with steps that the person skilled in the art immediately recognizes using the following description of the method for adjusting the print head in the first direction (φ).

In an exemplary embodiment, the misalignment of each print head 2 is determined with a computer from the scan of the test image. This computer then calculates for each print head a nominal value 16, for example as a fraction of rotations or as a rotation angle. This list with nominal values is then displayed or printed out as a table at a display device of the computer.

Figure 4:
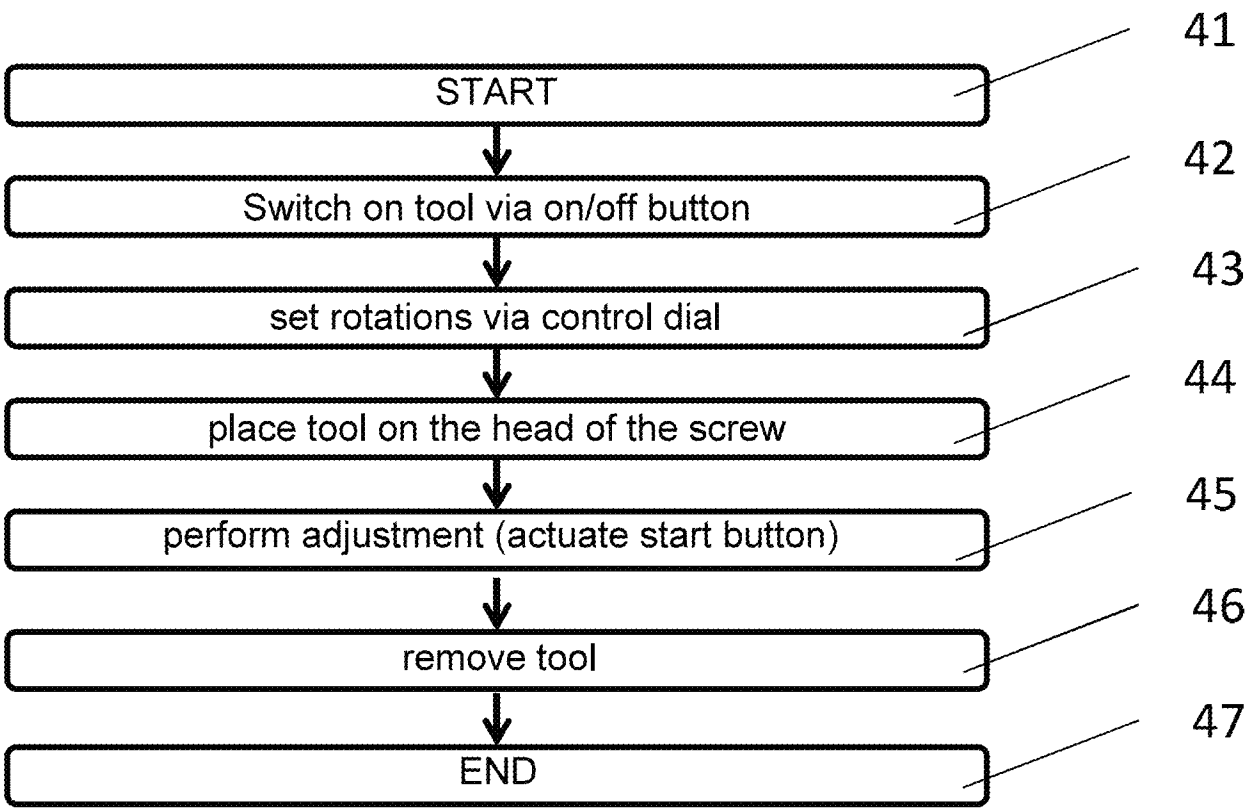
FIG. 4 is a flowchart of a method according to an exemplary embodiment.

A method according to an exemplary embodiment, for automatic adjustment of a print head as it is implemented by a user, is shown in FIG. 4.

In an exemplary embodiment, the method begins in step 41. In step 42, the user activates the device via one of the buttons 6. For step 43, he subsequently reads from the table the number of rotations that are required for this rotary knob, and inputs these into the controller of the device 20 via said rotary knob 7. For monitoring, the set value is indicated as a nominal value 16 with the direction indicators 5 and the indicator 8. In step 44, the automatic hand tool (also referred to as a tool), thus the device 20, is placed on the retaining elements 3 and the adjustment element 4.

Figure 5:
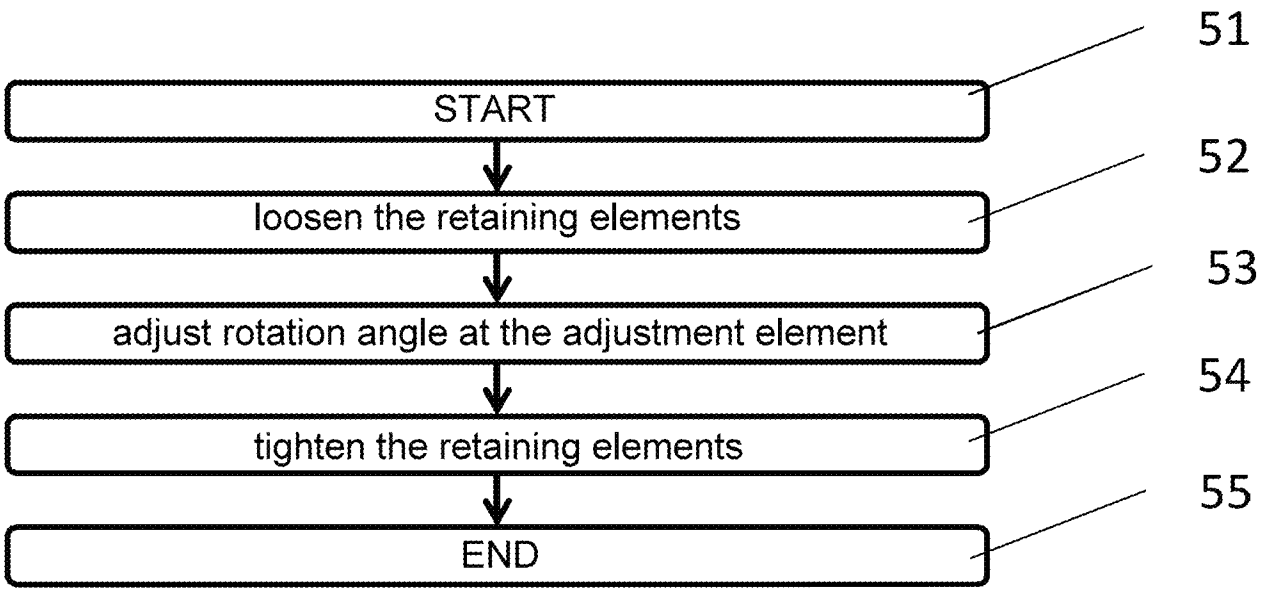
FIG. 5 is a flowchart of a method according to an exemplary embodiment.

The method for the adjustment of the print head according to an exemplary embodiment is depicted in FIG. 5. In an exemplary embodiment, the method begins via actuation of the start button in step 45. In step 46, the user subsequently removes the device 20 (referred to as a tool in FIG. 4) from the print head. The method for adjusting the print head ends in step 47. If applicable, the user may then begin with the method again at the next print head.

The method for the adjustment of a print head 2 itself as it is implemented in step 45 of FIG. 4 is shown in FIG. 5. In an exemplary embodiment, the method begins at step 51. First, the retaining element 3 is loosened in step 52. This occurs by rotating the motor 12 counter-clockwise, which motor 12 is controlled by the controller of the device 20, possibly with the nominal torque for this print head. In step 53, the motor 11 is driven by the controller so far that the respective adjustment element 4 is displaced by the nominal value 16 provided by the table. This nominal value may be a fraction of a rotation, as well as a value of more than one rotation. In an exemplary embodiment, in step 54, the retaining elements 3 are tightened. This occurs by rotating the motor 12 clockwise, which motor 12 is controlled by the controller of the device 20, possibly with the nominal torque for this print head. The method ends in step 55.

If an identification element is present at each print head, the method may be even further automated. Such identification elements may, for example, be RFID tags or mechanical coding devices such as keys or coding rings. In an exemplary embodiment, at the device 20, a corresponding RFID reader is then to be provided, or a reader for the mechanical coding device. Moreover, the table with nominal values 16 may arrive at the device 20 electronically if the operating element 7 is executed not as a rotary knob but rather as a communication element, for example a USB connector or a Bluetooth transceiver. Errors, such as the alignment of the wrong print head or the alignment of a print head in the wrong direction, may thus be prevented via automation.

In the preceding text, the direction of the through-transport of the recording medium below the print bar is understood as the longitudinal direction, and the dimension of the recording medium transversal (at a right angle) to the transport direction is understood as the width.

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 print bar
2 print head
3 retaining element
4 adjustment element
5 direction indicators
6 actuation button
7 operating element
8 indicator
9 grip
10 battery
11 motor (adjustment element)
12 motor (retaining element)
13 drive element for retaining element
14 controller
15 drive element for adjustment element
16 nominal value
20 adjustment apparatus

The invention claimed is:

1. A device for automatic adjustment of print heads in a printing machine, the device comprising:

at least one motor configured to:

drive at least one drive element for at least one retaining element, and drive at least one drive element for at least one adjustment element; and a controller configured to control the at least one motor to:

drive the at least one drive element to loosen the at least one retaining element, drive the at least one drive element to position the at least one adjustment element at a predetermined nominal value to position the adjustment element, and drive the at least one drive element to tighten the at least one retaining element.

2. The device according to claim 1, further comprising at least operating element configured to receive, as an input at the device, at least one nominal value for the at least one adjustment element.

3. The device according to claim 1, further comprising at least one operating element configured to receive, as an input at the device, at least one nominal value for the at least one retaining element.

4. The device according to claim 1, further comprising at least operating element configured to receive, as an input at the device, at least one nominal value for the at least one adjustment element and at least one nominal value for the at least one retaining element.

5. The device according to claim 2, wherein the operating element is a communication transceiver that is configured to receive the at least one nominal value for the at least one adjustment element, and/or for the at least one retaining element, as an input into the device.

6. The device according to claim 2, wherein the operating element is a communication interface configured to receive the at least one nominal value for the at least one adjustment element, and/or for the at least one retaining element, as an input into the device.

7. The device according to claim 2, wherein the nominal value is a rotation angle of the motor to drive the at least one drive element of the at least one adjustment element.

8. The device according to claim 3, wherein the nominal value is a torque of the motor to drive the at least one drive element of the at least one retaining element.

9. The device according to claim 1, wherein each print head is equipped with an identification element that can be connected with the device.

10. A method for automatic adjustment of print heads in a printing machine via an electronically-controlled hand tool having at least one motor configured to drive at least one drive element for at least one retaining element, and to drive at least one drive element for at least one adjustment element, the method comprising:

controlling the at least one motor, by a controller of the hand tool, to loosen the at least one retaining element;

controlling the at least one motor, by the controller, to position the at least one adjustment element at a predetermined nominal value for a position of said adjustment element; and controlling the at least one motor, by the controller, to tighten the at least one retaining element.

11. A non-transitory computer-readable storage medium with an executable program stored thereon, that when executed, instructs a processor to perform the method of claim 10.

* * * * *